US007536890B2

(12) United States Patent
Bulle

(10) Patent No.: US 7,536,890 B2
(45) Date of Patent: May 26, 2009

(54) ACUTE ANGLE METAL STOCK BENDER

(76) Inventor: Marshall R. Bulle, P.O. Box 340, Rye, CO (US) 81069

( * ) Notice: Subject to any disclaimer, the term of this patent is extended or adjusted under 35 U.S.C. 154(b) by 93 days.

(21) Appl. No.: 11/671,543

(22) Filed: Feb. 6, 2007

(65) Prior Publication Data

US 2008/0184758 A1 Aug. 7, 2008

(51) Int. Cl.
*B21D 7/04* (2006.01)
*B21D 9/05* (2006.01)
*B21J 13/08* (2006.01)

(52) U.S. Cl. ..... 72/155; 72/388; 72/459

(58) Field of Classification Search ..... 72/31.04, 72/31.05, 149, 155, 156, 159, 217, 219, 388, 72/459, 153

See application file for complete search history.

(56) References Cited

U.S. PATENT DOCUMENTS 2,656,872 A 10/1953 Mann et al. ..... 153/46
4,055,065 A 10/1977 Whetstone, Jr. et al. ..... 72/217
5,626,045 A 5/1997 Bulle ..... 72/219
6,463,780 B1 10/2002 Kalanish ..... 72/388
6,804,980 B2 10/2004 Bulle ..... 72/64

*Primary Examiner*—Dana Ross
*Assistant Examiner*—Teresa Bonk
(74) *Attorney, Agent, or Firm*—Nawrocki, Rooney & Sivertson, P.A.

(57) ABSTRACT

Apparatus for bending stock to an acute angle. A hydraulic cylinder with a ram extendable under hydraulic pressure provides the bending power. The ram automatically retracts from an extended position when hydraulic pressure is removed. One end of an apparatus supporting arm consists of a slide bar. The slide bar end of the arm is secured to a support with the opposite end pivotably mounting a forming die and a lever. The lever pivotably mounts a forming roller. The lever carries the forming roller around the die and bend stock secured to the die around the die. A slide is slideably attached to the slide bar. The cylinder and ram are pivotably attached extending between the slide and the lever. With this arrangement providing hydraulic pressure to extend the ram will rotate the lever and forming roller around the die and bend secured stock around the die, then removing pressure will retract the ram and move the slide with the attached cylinder and ram towards the die where the slide is automatically locked in place. This permits making an acute angle bend by successive bends with the cylinder and ram at two different locations with respect to the die.

8 Claims, 18 Drawing Sheets

48A
48B
48

64B
64A
64

62A
62C
62B
62

60A
60
60C
60B 44
44C
44B
44A 50
48
60
44B
60
44C
44
62
50
64A
64
15
14A
46
42C
42
16
16
42B
60
42D
28D
28
40
32
32
30
30B,40A
28
34
12

ACUTE ANGLE METAL STOCK BENDER

FIELD OF THE INVENTION

This invention relates to an improved apparatus for bending metal stock on the arc of a circle up to an acute angle of one hundred and eighty degrees.

BACKGROUND OF THE INVENTION

A large force is required to bend stock to an acute angle of one hundred and eighty degrees. Bending apparatus which requires such a large force uses a hydraulic cylinder with an extending ram. An extension of the ram transmits the force to apparatus which bears against the stock and bends it. An acute angle bend presents a problem compared to smaller bends because the force required is large and must be exerted over a long distance. This is difficult to achieve with a cylinder and ram because the long distance requires a long cylinder and ram which are both prone to buckling under such a large force.

While a variety of metal stock benders are known in the art, the ability to bend stock to an acute 180 degree angle has only been provided by Mann et al. U.S. Pat. No. 2,656,872. Mann et al. utilizes a swinging frame which changes the angle and distance of the frame with respect to a forming die. This permits making a large bend by making smaller bends at each location. This apparatus is fairly complex and requires a substantial amount of shop space because of the size of the frame and the size of the arc.

SUMMARY OF THE INVENTION

This invention is a shop tool which overcomes previous problems in bending metal stock up to 180 degrees by translating a slide along a slide bar portion of a linear arm to provide two cylinder locations. One end of the arm provides the slide bar portion end and the opposite end of the arm pivotably mounts a lever and die. The lever has a form roller pivotably mounted between its ends which rotates around the die at a given distance when the lever is rotated around the die.

A stop mounted on the support opposite to the slide bar is arranged to prevent the slide from moving off of the end of the slide bar adjacent to the support. A hydraulic cylinder has a ram which extends under hydraulic pressure and retracts when the pressure is removed. Opposite ends of the cylinder and the ram are attached between the slide and the lever. With this arrangement extending the ram will rotate the lever around the die and retracting an extended ram will pull the slide outward from the stop toward the die along the slide bar. The slide has a pivotably mounted spring loaded clapper arranged to urge a gudgeon through an aligned hole in the slide against the slide bar. The slide bar has a hole sized and arranged to receive the gudgeon. The slide bar hole is aligned with the gudgeon when the slide is at a predetermined location inward from the stop. This permits the gudgeon to be urged through the aligned hole and automatically lock the slide to the slide bar at that location. The clapper has a handle arranged to permit rotating the clapper and remove the gudgeon from the hole in the slide bar to manually unlock the slide from the slide bar. This arrangement provides an outer first and an inner second location for the cylinder and ram relative to the die.

In making a 180 degree bend, before making the first bend the slide must be positioned adjacent to the stop with the ram retracted. The stock is attached adjacent to the die with the die secured against rotation relative to the arm. The ram is then extended to rotate the lever and make the first bend by rotating the form roller around the die to force the stock against the die. Hydraulic pressure is then removed from the cylinder which retracts the ram and translates the slide along the slide bar towards the die which also translates the attached cylinder and ram. The slide is automatically locked to the slide bar at the second location relative to the die, as described above, ready for a second bend. The second bend is then provided by again extending the ram.

The parts of the apparatus are sized such that the first bend will bend the stock 45 degrees, and the second bend will bend the stock an additional 45 degrees for a total of 90 degrees.

After the first two bending steps, hydraulic pressure is again removed from the cylinder which retracts the ram. The slide is then manually unlocked and manually moved outward to the stop at the first location. The die and stock are rotated 90 degrees together in the direction where additional bending will add to the previous 90 degree bend, and the die rotation is again locked.

A third bending step, identical to the first, is then used to bend the stock from 90 degrees to 135 degrees. The cylinder pressure is removed to retract the arm and move the slide closer to the die as described above. A fourth bending step, identical in operation to the second is then made, bends the stock from 135 degrees to 180 degrees.

While the apparatus is normally operated by a force provided by a cylinder, the bender is arranged to permit the use of an operating handle to bend stock that requires less force than the cylinder provides. If desired, the operating handle can also be used to move the slide from the inner to the outer position. The operating handle can telescope to provide additional leverage for manual bending. Whether hydraulic power or manual power is used is determined simply by how much power is required to bend the particular metal stock. The lever and cylinder are arranged to permit having both the cylinder and lever connected during bending even though only one provides the bending force, to disconnect either the piston or lever and bend with a selected one of the elements, or to completely remove either the piston or the lever and bend with the connected element.

A pneumatic source is used to power a hydraulic pump to provide pressurized hydraulic fluid to the cylinder. The pump has an integral hydraulic fluid reservoir for hydraulic fluid and a foot control. The foot control turns on the pump and controls the pump speed and can also retract the ram by allowing the hydraulic fluid to return to the reservoir and reduce the hydraulic pressure. This arrangement completely eliminates the use of electricity to power or to control operate the apparatus. Since a shop environment is rugged and hazardous, this complete elimination of electricity ensures that an operator will not be injured by electricity when using this equipment.

DETAILED DESCRIPTION OF THE INVENTION

Figure 1:
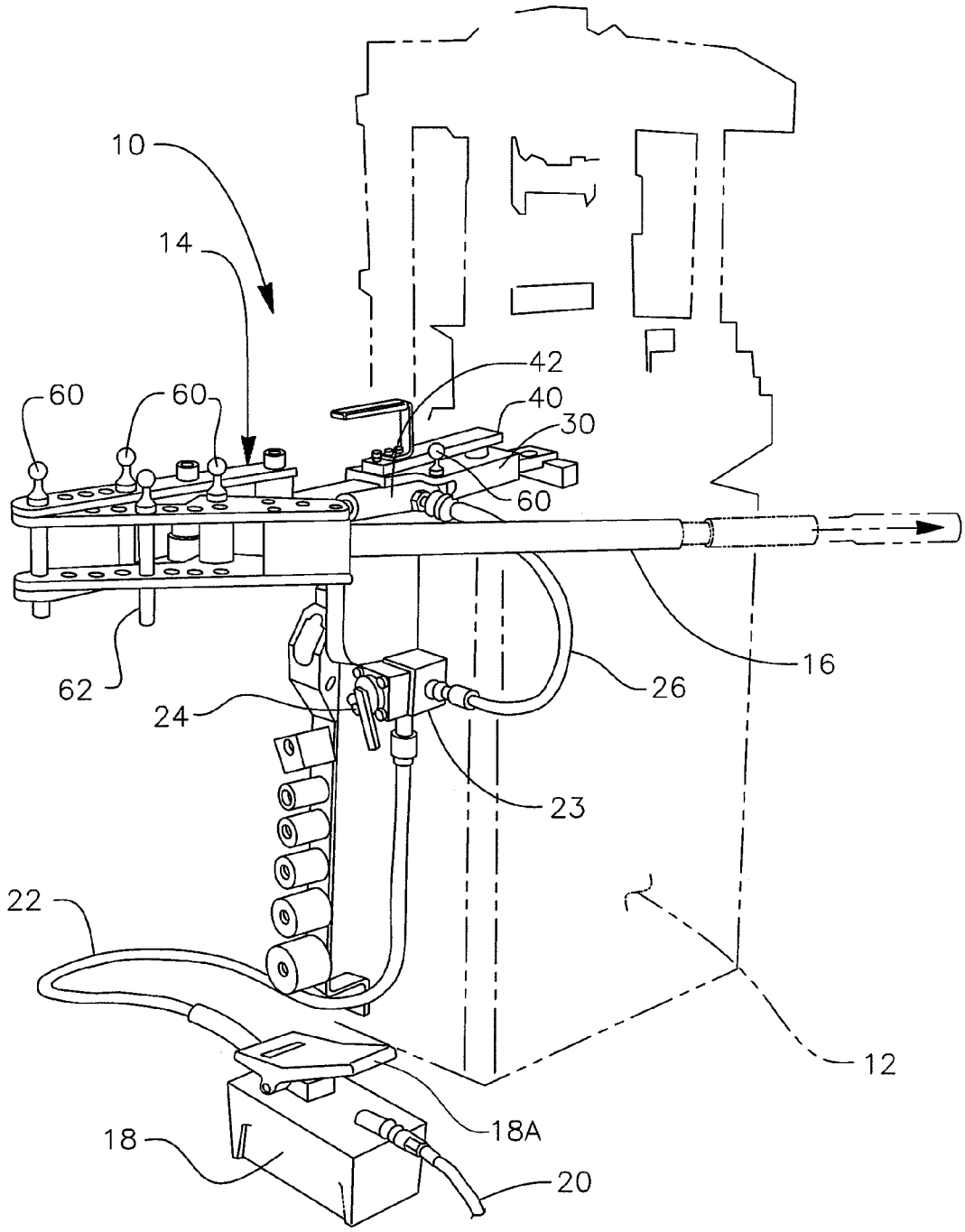
FIG. 1 is an isometric view of the apparatus and support.
Figure 2:
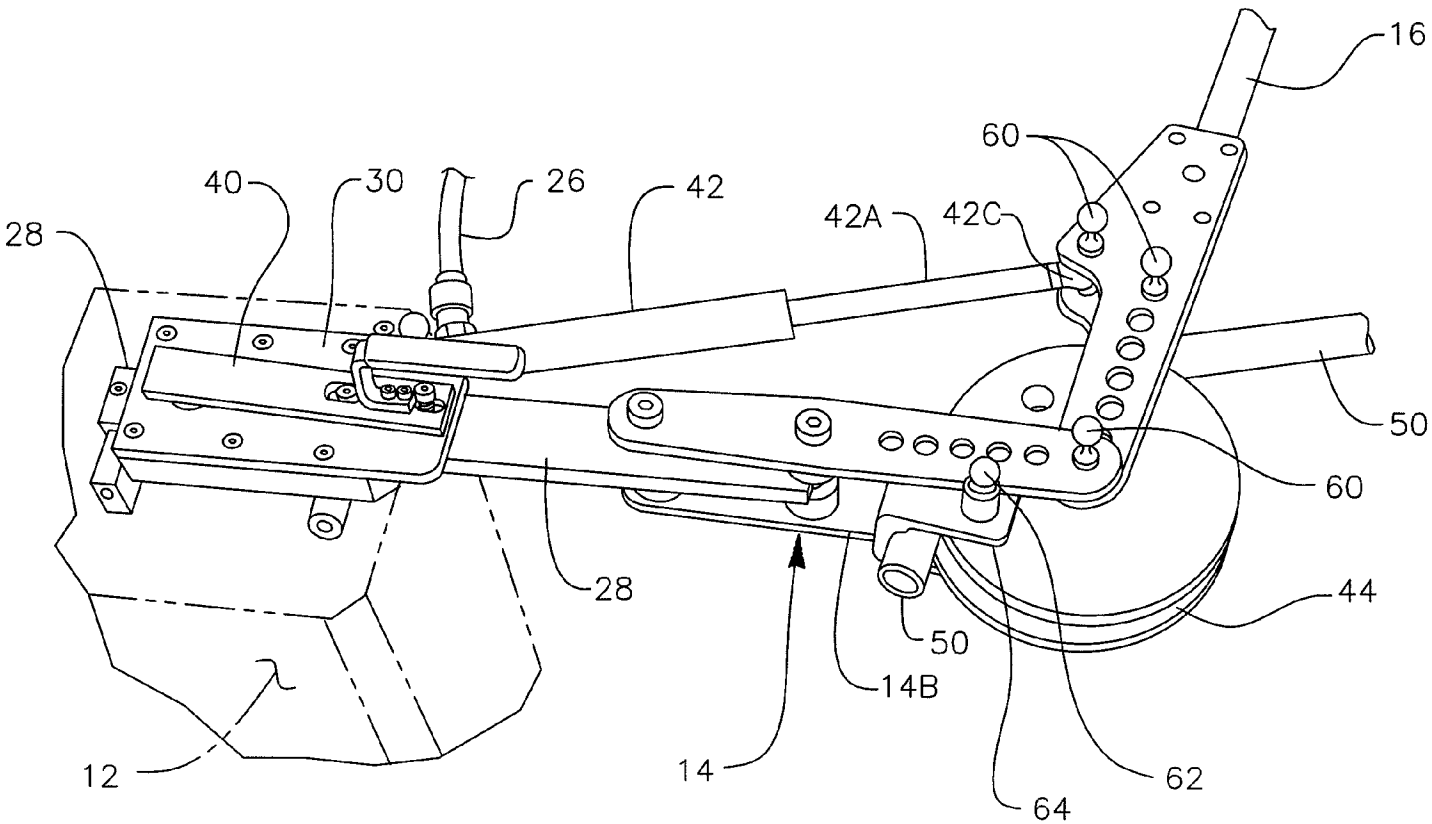
FIG. 2 is an isometric top side view of a portion of the apparatus and stand.
Figure 3:
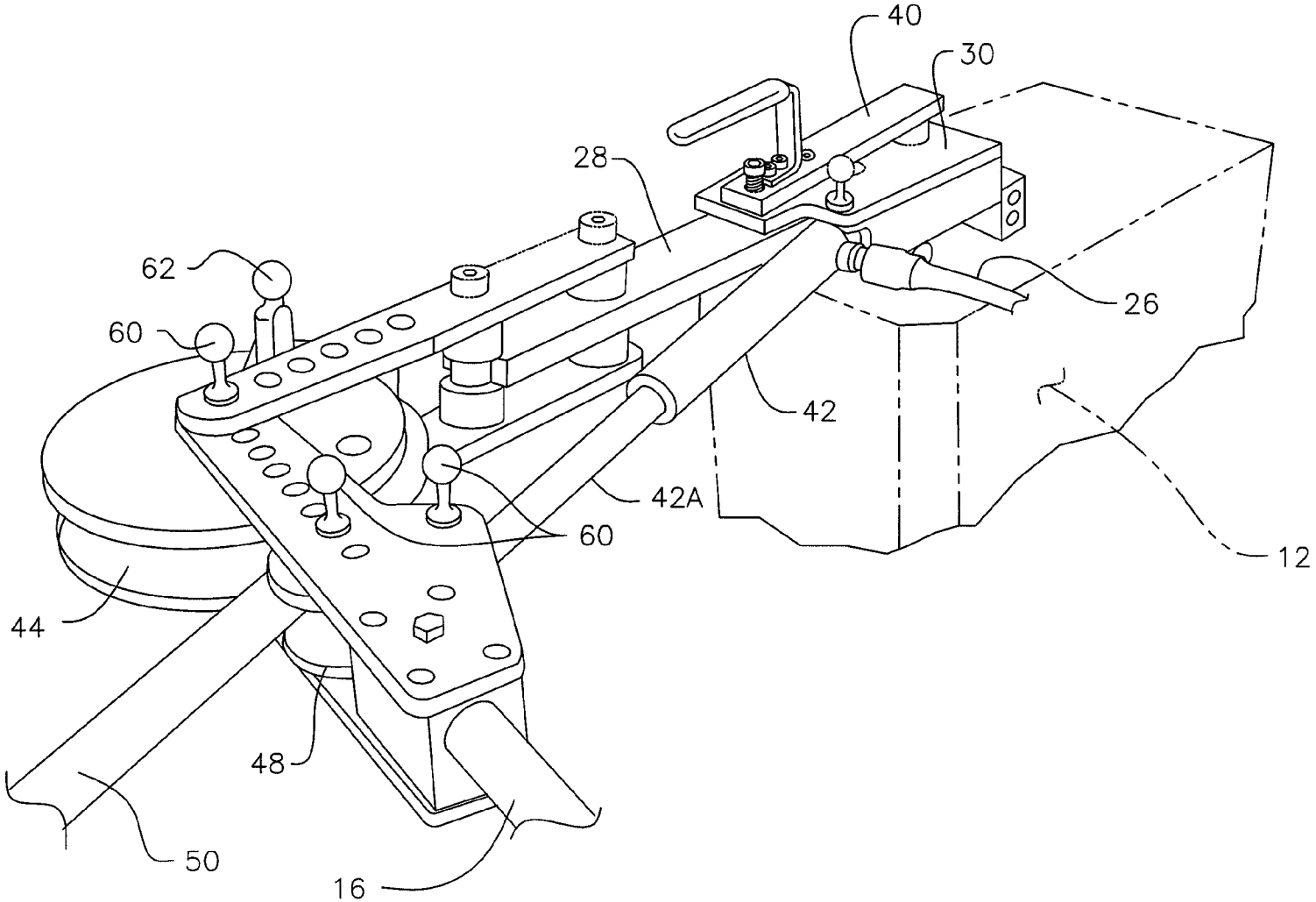
FIG. 3 is an is an isometric end view of a portion of the apparatus and stand.

FIGS. 1-9 show details of the operating elements of apparatus 10 and arm 14 which supports the various elements. Apparatus 10 has means for connecting various bending elements or limit the range of operation of these elements. The elements are either connected or the range of bending operation determined by belaying pins 60 or flat sided belaying ins 62, described further later, both of which fit into the same size holes in a number of locations in apparatus 10 to permit attaching accessories which provide these various functions.

FIGS. 4-7 show the inner end of arm 14 which is attached to support 12. The inner portion of arm 14 consists of slide bar 28 which is oriented to guide slide 30 on a linear path from support 12. Slide bar 28 has planar surfaces. Slide 30 has planar surfaces with a pair of side plates 32 attached to its slide which extend downward over opposite sides of slide bar 28, each side plate having inwardly extending extensions 32A which grip the underside of the slide bar. Slide bar 28 is mounted above support 12 to permit slide 30 to slide with respect to the upper surface of the slide bar. This arrangement of slide 30, side plates 32 and extensions 32A permit the slide to slideably translate along the slide bar while still being held securely against the upper surface of the slide bar.

The lower inner end of slide bar 28 adjacent to stop 34 has a right angle notch 28A facing the stop. Slide bar 28 is secured to stop 34 with the notch facing the upper end of stop 34 by bolt 30A. Bolt 30A extends through a mating hole in slide bar 28, then through a hole in stop 34, not shown, and finally into a threaded hole in support 12, not shown, which mates with the threaded end of bolt 30A to attach the inward end of slide bar 28 to support 12. With this arrangement stop 34 will prevent the end of slide 30, when slideably attached to slide bar 28, from moving inward beyond the stop.

Figure 5:
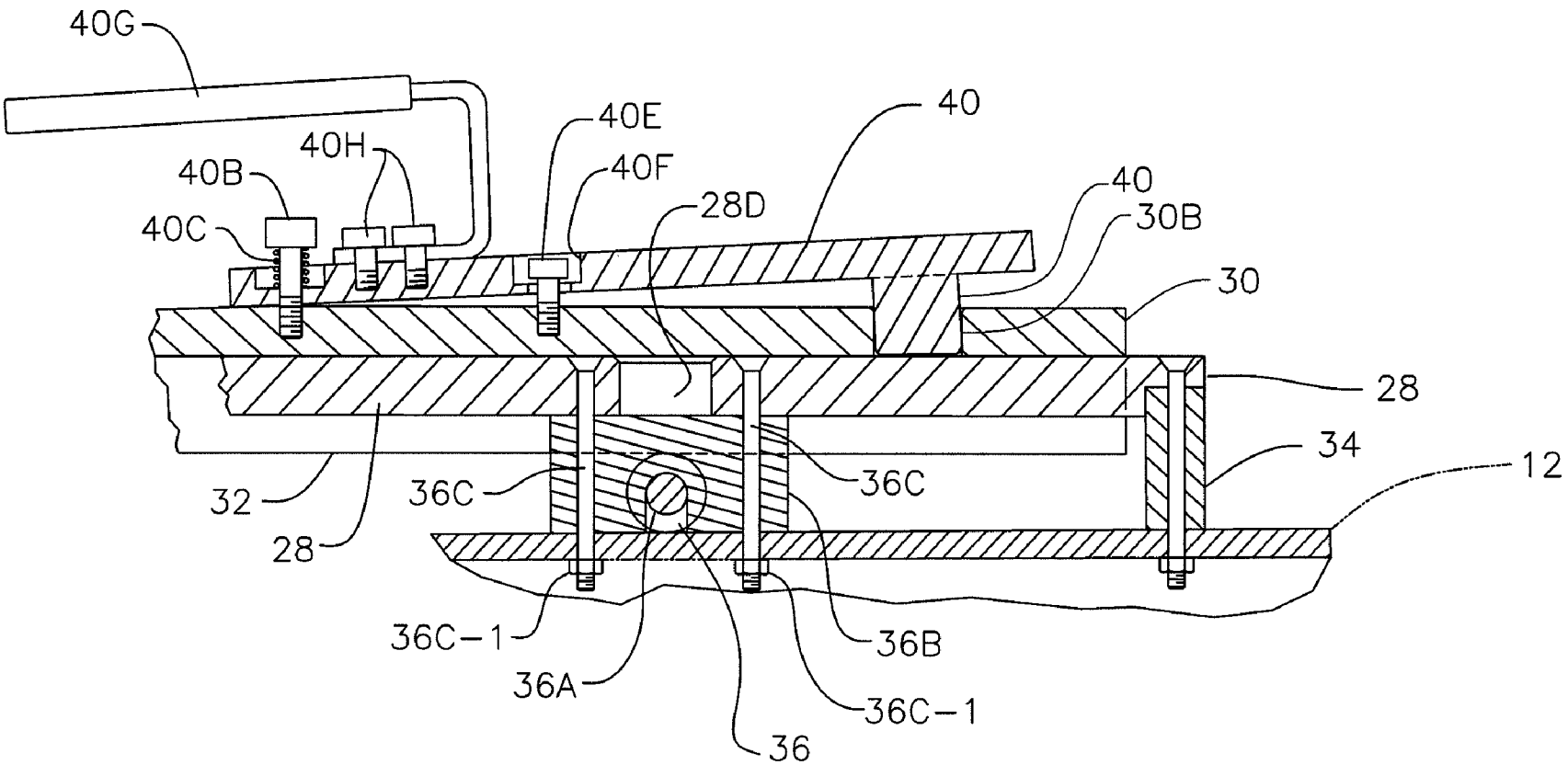
FIG. 5 is a cross-section view of the slide, slide bar and support.
Figure 5A:
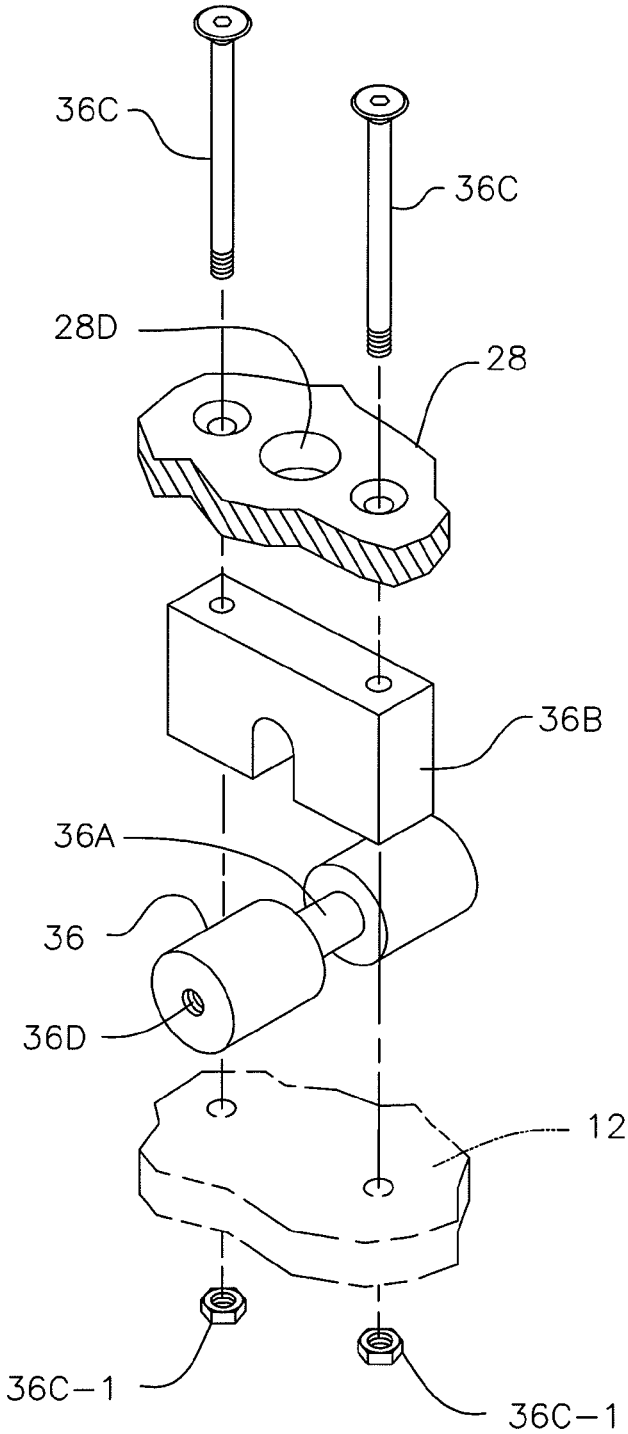
FIG. 5A is an expanded view of the attachment portion of the slide bar and the support.

As shown in FIG. 5A, calendrical shaped roller 36 positioned under slide bar 28 has a centered groove 36A. Bracket 36B, which has a centered groove which matches groove 36A, is attached to slide bar 28 and support 12 by threaded bolts 36C which extend through aligned holes in slide bar 28, bracket 36B and support 12 are secured by nuts 36C-1 which attache slide bar 28 to support 12. The centered groove 36A of bracket 36B centers roller 36 below slide bar 28. Roller 36 and stop 34 are sized such that slide bar 28 is supported horizontally.

Threaded holes 36D in opposite ends of roller 36 and holes 34B on opposite sides of stop 34 provide a means for attaching side plates, not shown, to prevent the operator from being exposed to injury by the movement of slide 30. Roller 36 is short to prevent the side plates from interfering with slide 30.

Figure 4:
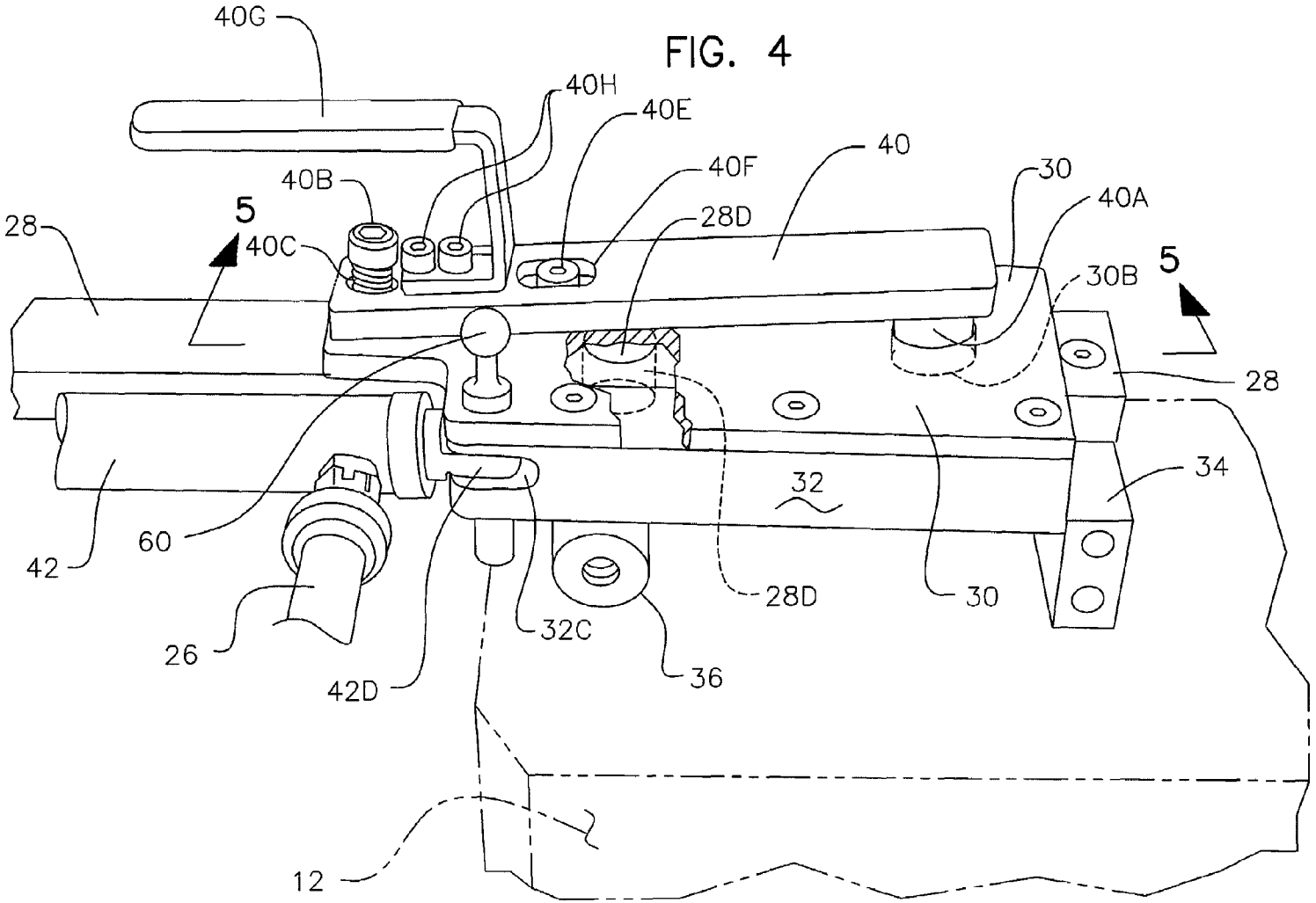
FIG. 4 is an isometric top side view of the slide, slide bar and support.
Figure 6:
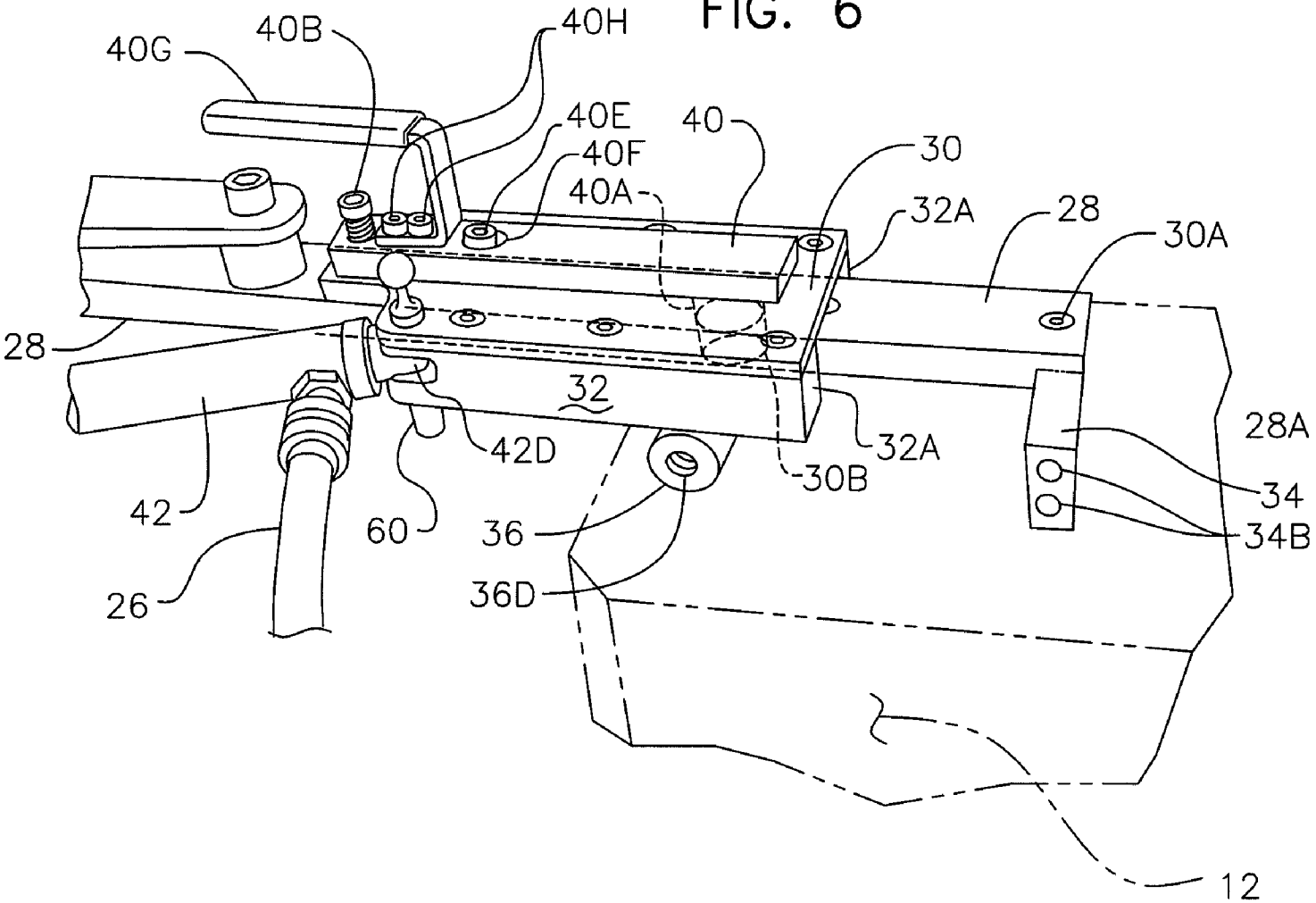
FIG. 6 is a top isometric view of the slide, slide bar and support.
Figure 7:
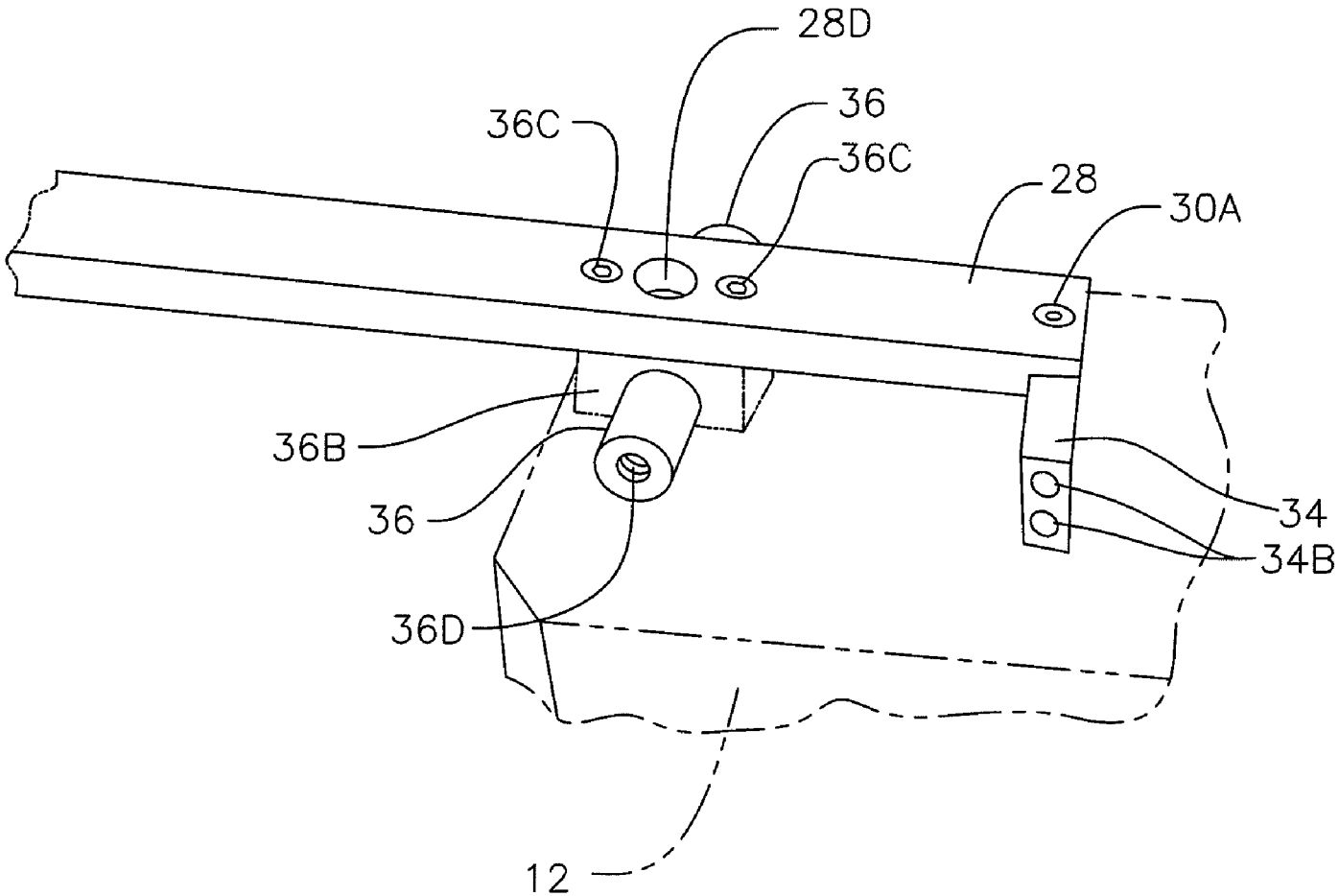
FIG. 7 is a top isometric view of the slide bar and support.

FIGS. 4-6 show the mechanisms relating to slide 30 and slide bar 28. A cylinder shaped gudgeon 40A has planar ends perpendicular to the axis of the cylinder. One end of gudgeon 40A is attached to the undersurface of clapper 40 near one end. Clapper 40 is pivotably attached to slide 30 with gudgeon 40A facing the slide near the end of the slide adjacent to stop 34. The pivot is formed by threaded bolt 40B extending through a coil spring 40C located within a hole in clapper 40, enlarged near the bolt head to accommodate the spring, with the opposite end of the bolt anchored in a mating threaded hole in slide 30. Clapper 40 is aligned with slide 30 by a threaded bolt 40E into a slot aligned with the clapper anchored in a mating threaded hole in slide 30*k*. The slot of slotted hole 40F extends along the length of clapper 40 to permit clapper 40 to pivot about bolt 40B with spring 40 C forcing gudgeon 40A against the adjacent surface of slide 30.

A clapper handle 40G is attached to clapper 40 by a pair of bolts 40H through mating holes in the handle and are secured by aligned mating threaded holes in clapper 40.

Slide 30 has a cylindrical shaped hole 30B and slide bar 28 has the same sized cylindrical shaped hole 28D, with both holes being sized to readily admit gudgeon 40A when clapper 40 is adjacent to slide 30. Hole 30B in slide 30 permits spring 40C to pivot clapper 40 and urge gudgeon 40A downward through slide 30 against the upper surface of slide bar 28. Spring 40C will also force gudgeon 40A into hole 28D in slide bar 28 when hole 30B is opposite hole 28D which automatically locks slide 30 to slide bar 28.

Downward pressure on the outer end of clapper handle 40G, with enough force to overcome the force of spring 40C, will cause the end of clapper 40 opposite the clapper handle to pivot upward and remove the gudgeon 40A located within hole 28D in slide bar 28 and release slide 30 from slide bar 28. With slide 30 released from slide bar 28, the slide can be moved manually, as described later.

FIGS. 1-3, 8 and 9 show the elements required for the operation of apparatus 10. Hydraulic pump 18 is a Shinn Fu manufactured Model No. CA 1500, which is driven by air pressure and pumps hydraulic oil from an integral reservoir. Pump 18 receives pressurized air through air hose 20 from a source, not shown, which provides energy to the pump to pump hydraulic fluid from the reservoir. Pump 18 is controlled by foot control 18A. Downward inclination of one end of the foot control will turn the pump on and pump hydraulic fluid at a rate directly proportional to the inclination of the foot control from an integral fluid reservoir in the base of the pump. Downward inclination of the opposite end of the foot control will release hydraulic pressure by allowing the fluid to return to the reservoir from the cylinder.

Diversion valve 23 has an input connected to hydraulic hose 22 and two outputs, one connected to hydraulic cylinder 42 through hydraulic output hose 28, and the other output being available to operate other equipment. Diversion valve 24 has a handle which switches the valve between these two outputs. With this arrangement, when the output of diversion valve 24 is connected to hydraulic hose 22, foot control 18A will control the flow and pressure of hydraulic fluid through hose 26 to cylinder 42. Cylinder 42 is a Shinn Fu Model No. HO 509 which has a ram 42A which is extended proportional to the amount of hydraulic fluid in the cylinder. In this model if the pressure is removed and the fluid is allowed to drain from cylinder 42 when ram 42A is extended, the ram will retract automatically.

Ram 42A has a ram ring connector 42C on its outer end, and cylinder 42 has a similar sized cylinder ring connector 42D on the end opposite to the ram. Both ram ring connector 42C and cylinder connector 42D are sized to admit a belaying pin 60.

A slot 32C in slide 30 is sized to pivotably receive cylinder ring connector 42D, which is secured in the slot by belaying pin 60, through opposed mating holes.

Figure 8:
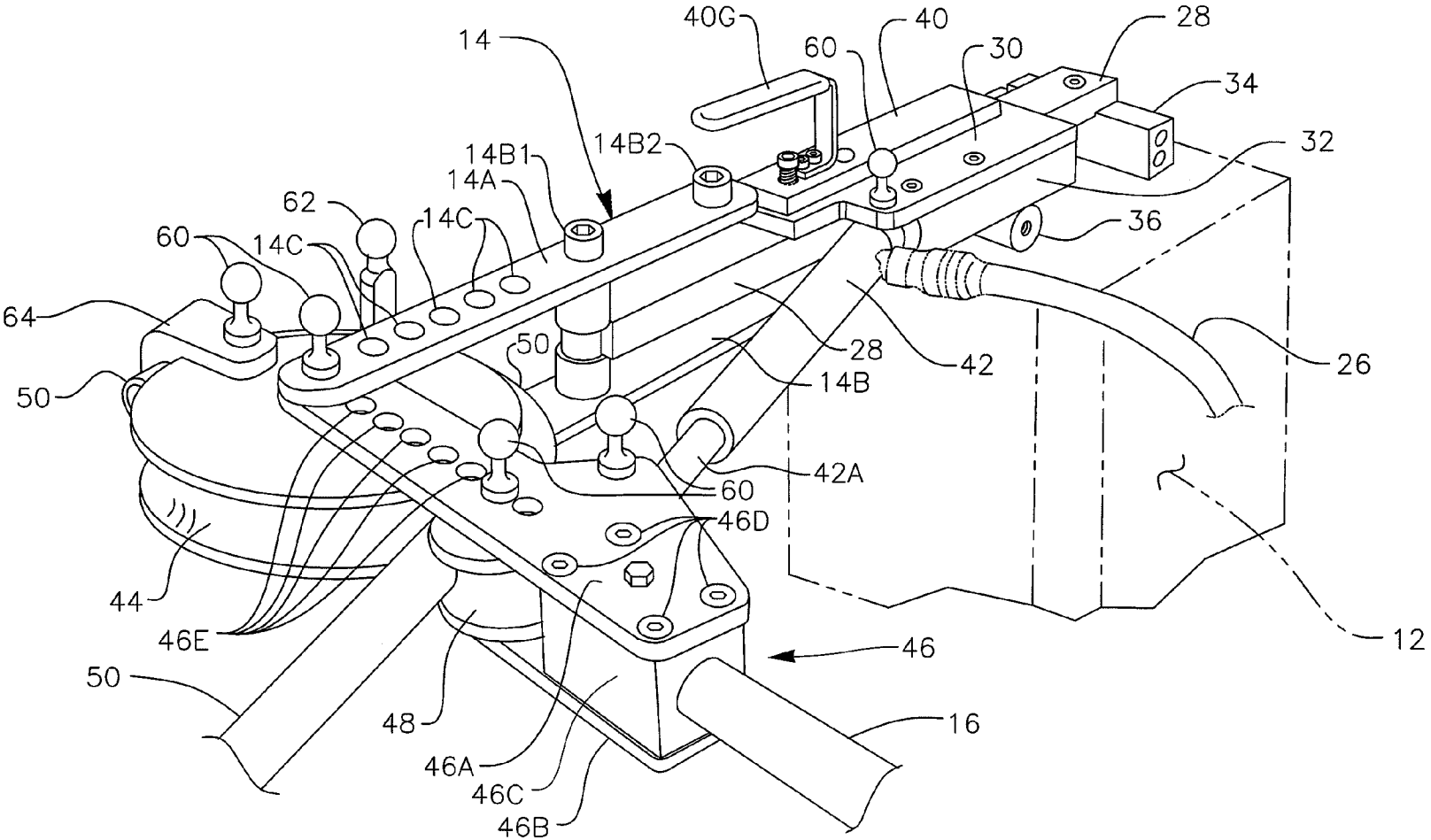
FIG. 8 is a top isometric quarter end view of the bending apparatus and the top portion of the support.
Figure 9:
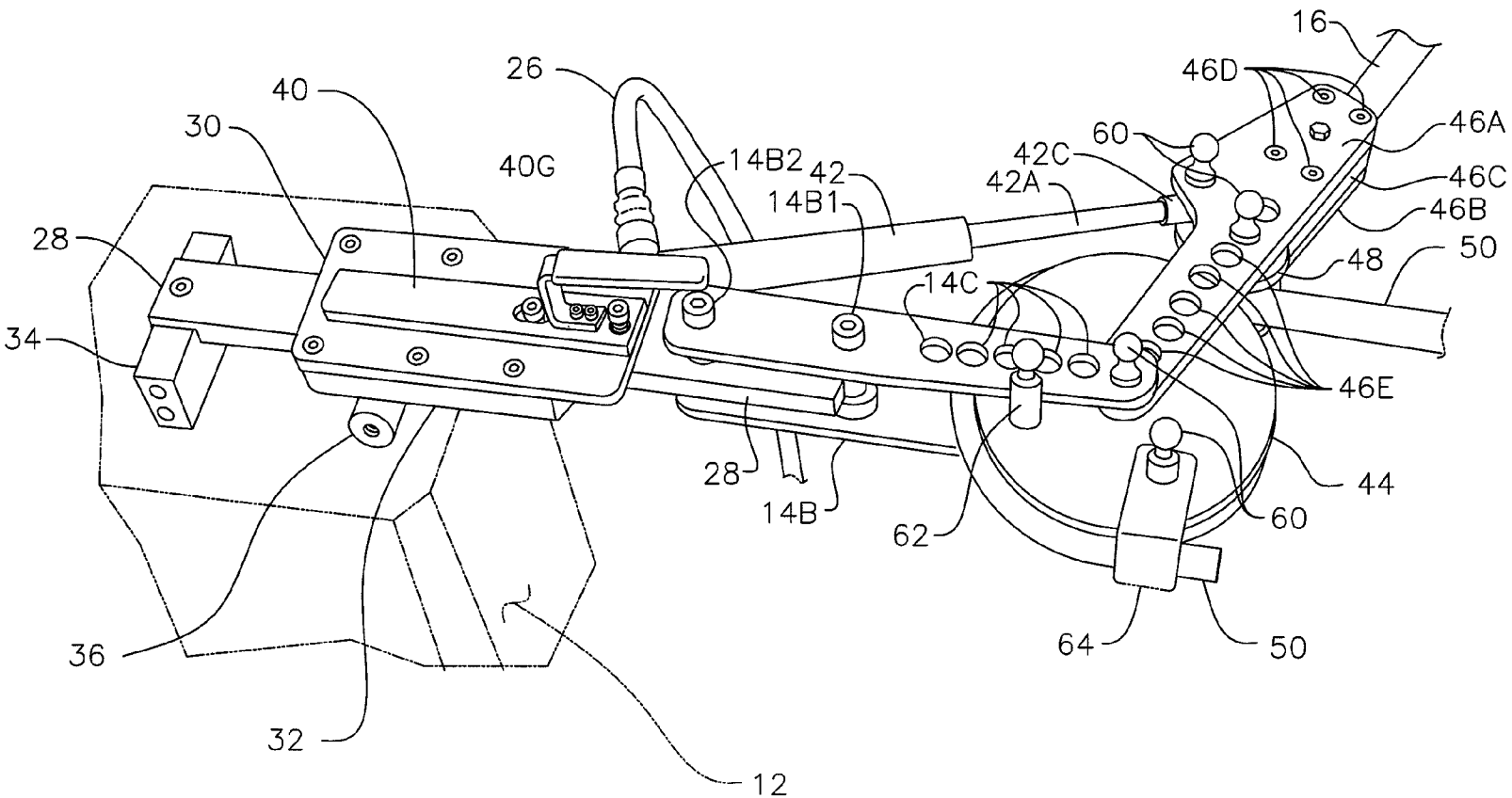
FIG. 9 is a side top isometric view of the apparatus and support.

FIGS. 8 and 9 show slide bar 28 with arm 14 having an upper extension 14A and a lower extension 14B attached to the opposite slide bar 28 end by bolts 14B1 and 14B2. Upper extension 14A and lower extension 14B together form an arm extension. Bolt 14B1 extends through a mating hole in upper extension 14A, through a mating hole in a cylindrical shaped spacers, downward within a mating semi-circular cut-out in the outer end of slide bar 28, through a mating hole in a lower cylindrical shaped spacer, and through a mating hole in lower extension 14B where it is secured by a mating nut. Semi-circular cut-outs in the outer ends of extensions 14A and 14B provide a space for the cross-section of stock 50. A number of equally spaced aligned holes 14C along the length of extensions 14A and 14B are sized to receive a pin 60 to permit changing the location of various parts.

Identical upper lever 46A and lower lever 46B are elements of lever 46 which couples the force from cylinder 42 to bend stock 50 around die 44 when ram 42A is extended, described further later. A spacer 46C is located between the outer end of upper lever 46A and lower lever 46B. Four bolts 46D, arranged in an essentially rectangular pattern, extend through mating holes in upper lever 46A, through aligned mating holes, in spacer 46C, and finally through aligned mating holes in lower lever 46B, where they are secured in place by mating nuts which secure the two opposed parts of lever 46 together.

Operating lever 16, which has a threaded end, extends into a mating threaded hole in spacer 46C. Operating lever 16 is telescoping to vary the leverage and can be used to manipulate the bending elements of the bender when cylinder 42 is not used, or can provide an assist in arranging the apparatus for subsequent bending operations when using power, described later.

Form roller 48 has a centered hole sized to receive a pin 60. A linear set of equally spaced holes 46E, sized to receive a pin 60, extending through upper lever 46A and lower lever 46B each having a hole in the upper lever aligned with a hole in the lower lever. Form roller 48 is secured between upper lever 46A and lower lever 46B of lever 46 by a pin 60 through a pair of aligned holes 46E. This arrangement permits securing a variety of shapes and sizes of form rollers 48 at various locations. Forming die 44 has a centered hole sized to receive a pin 60. A pin 60 extends between the aligned end holes in upper arm extension 14A, through an end hole in upper lever 46A, through a centered hole in die 44, through an end hole in lower lever 46B, and through an end hole in lower arm extension. This pivots an end of lever 46 and the center of die 44 at the outer end of arm 14. With this arrangement pivoting lever 46 around die 44 will cause form roller 48 to rotate around the die at a predetermined distance and bend stock 50 attached to the die to its shape.

Aligned mating holes in the side of lever 46 facing support 12 between upper lever 46A and lower lever 46B attach ram ring connector 42C pivotably by pin 60. Cylinder ring connector 42D at the end of cylinder 42 was used to pivotably connect the cylinder to slide 30. With this arrangement when ram 42A is extended lever 46 will rotate around die 44 at a predetermined distance.

FIGS. 8 and 9 shows the arrangement of apparatus 10 at the end of a 180 degree bend. Here the end of stock 50 is secured within the arcuate groove 44D of die 44 by clevis 64 secured against the die by pin 60 extending through holes 64A in the clevis. Stock 50 was bent 180 degrees around die 44 within arcuate groove 44D by form roller 48.

FIGS. 1-9 described above show the various bending elements of the apparatus and their individual functions in the bending process. The following description of FIGS. 10-17 shows the arrangement of these elements and their operation in the four sequential bending steps which are required to complete a 180 degree bend.

Figures 10, 10A, 10B, 10C, 10D, 10E:
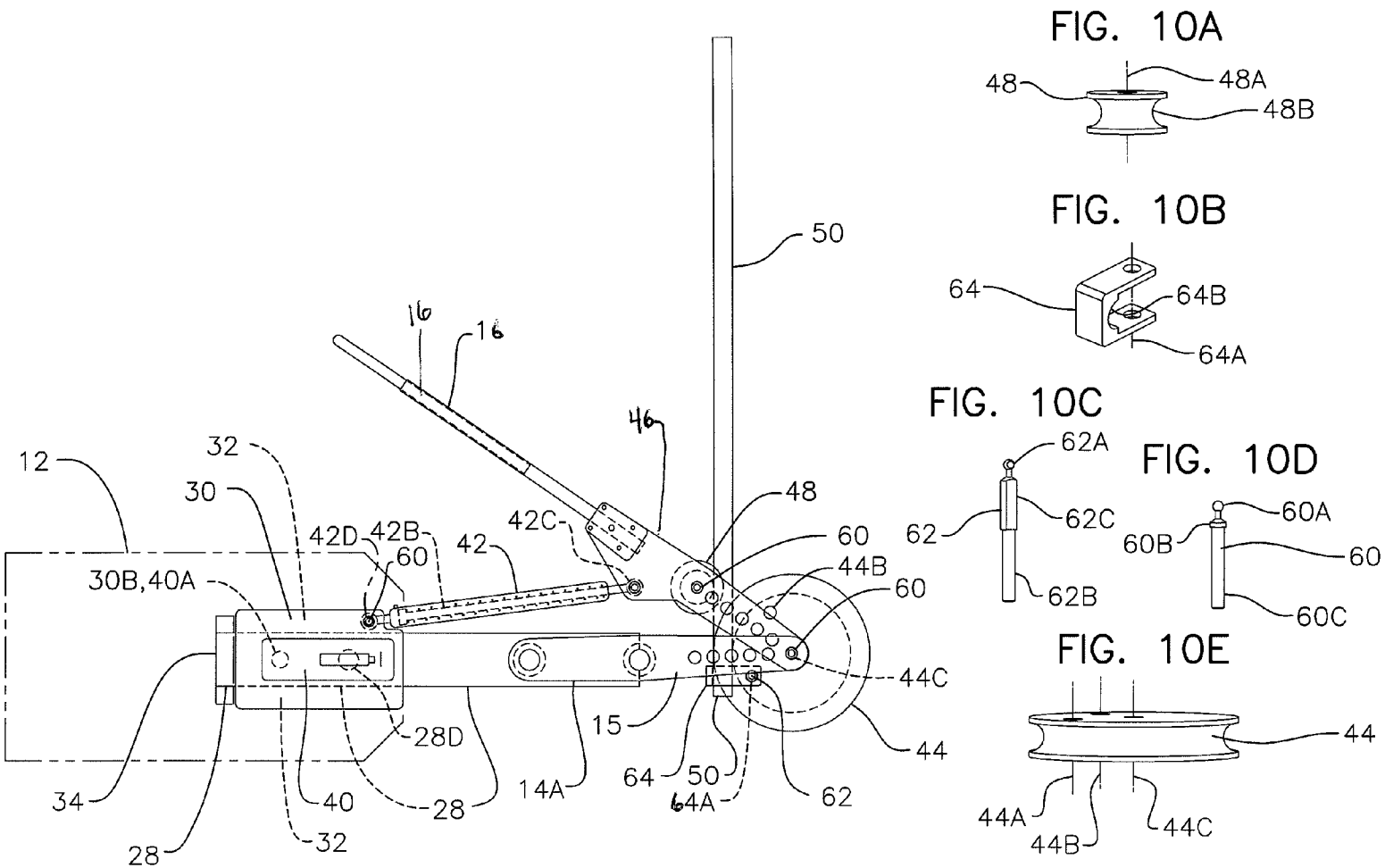
FIG. 10 shows a top view of the apparatus and support prior to the first bend.

FIG. 10A shows form roller 48 with a bore 48A sized for belaying pin 60, and actuate groove 48B around its periphery sized to fit around a portion of stock 50. FIG. 10B shows clevis 64 with an axle bore 64A sized to receive a flat sized pin 62, and an arcuate cut 64B sized to receive stock 50 and also fit over the edge of die 44. FIG. 10C shows a flat sided belaying pin 62 with a pommel 62A, a flat side 62B and an axle 62C. FIG. 10D shows belaying pin 60 with a pommel 60A, a collar 60B and an axle 60C. Belaying pins 60 and flat sided pins 62 both fit within the same size holes in apparatus 10 however the belaying arcuate groove 44D of die 44 by clevis 64 which is secured through a first stop hole 44A by a pin 60 pins provide for the ready connection of the various operating parts at various locations on apparatus 10, while the flat sided pins are used to limit the rotation angle of die 44 as described later. FIG. 10E shows die 44 which has a first stop hole 44A and a second stop hole 44B both of which are used with flat sided pin 62 to limit the rotation of die 44, and a centered hole 44C which is used with belaying pin 60 to rotatably mount the die to arm extension 15. Die 44 has an arcuate groove 44D which is sized to admit a portion of the cross-section of stock 50.

FIG. 10 shows a top view of bender apparatus 10 arranged as required to make a first bend. Slide 40 is positioned at an outer first location adjacent to stop 34. Die 44 and the outer end of lever 46 are pivotably mounted between upper arm extension 14A and lower arm extension 14B of arm 141 by belaying pin 60. Form roller 48 is connected between upper lever 46A and lower lever 46B by belaying pin 60. Stock 40 is held in place against die 44 by clevis 64 which has its arcuate cut 64B extending first around the stock then over the outer edge of die 44 and is secured by flat sided belaying pin 62 extending through stop hole 44A in die 44 and axle bore 64A in clevis 64 with the flat side of the pin facing arm 14. The flat side 62C of pin 62 bearing against upper extension 28E and lower extension 28F of arm extension 15 prevents die 44 from rotating in a clockwise direction and provides a reference starting point for the bend. Ram ring connector 42C is pivotably connected between upper lever 46A and lower lever 46B by belaying pin 60. Cylinder ring connector 42D is pivotably connected in slot 32C by belaying pin 60.

When using cylinder 42 to provide the bending power it is optional whether handle 16 is attached to spacer 46C. It is optional because having both operating handle 16 and cylinder 42 connected will not interfere with the operation of apparatus 10, and either can be readily disconnected to use the other to power the bend by simply removing a belaying pin 60. When cylinder 42 is used to bend stock 50, apparatus 10 is powered for operation by providing pneumatic pressure to hydraulic pump 18. In setting apparatus up for the first bend if slide 44 were located at the inner location closer to die 44, manually positioning the slide to the outer location. ++This would require retracting gudgeon 42 of clapper 40 from cylindrical shaped hole 28D by pushing down on the outer end of clapper handle 40G, then either pushing against the slide itself, or if handle 16 is connected, moving operating handle 16 in the direction which will move the slide outward.

Figure 11:
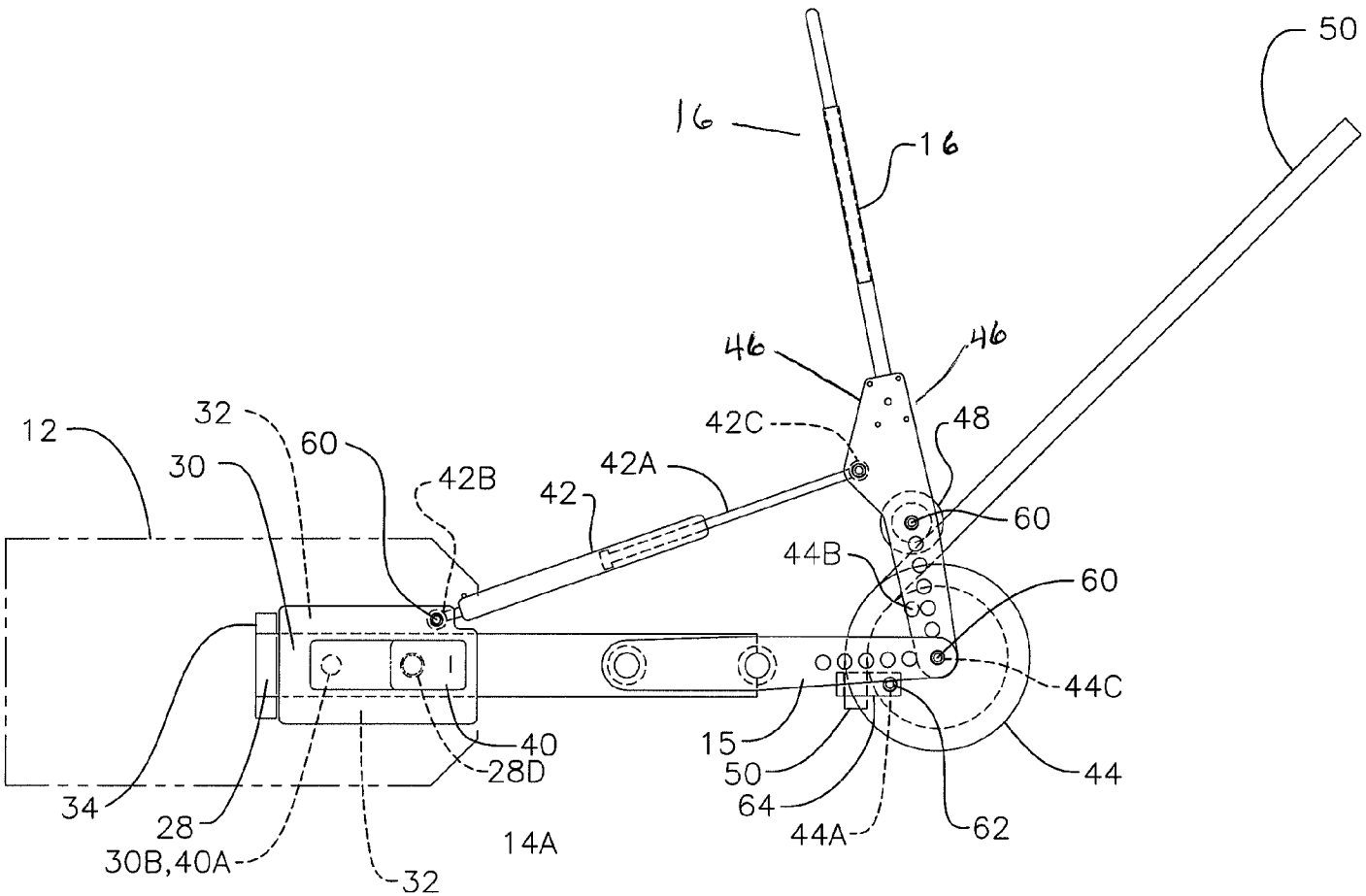
FIG. 11 shows a top view of the apparatus and support after the first bend.

FIG. 11 shows the result after using foot control valve 18 to make the first bend to provide hydraulic pressure to cylinder 42. This extended ram 42A from the position shown in FIG. 10 to the position shown in FIG. 11. The outer end of slide 30 was forced outward against stop 34 by cylinder 42 when ram 42A was extended. The extension of ram 42A caused lever 46 to rotate form roller 48 around die 44 and bent stock 50 approximately 45 degrees around die 44.

Figure 12:
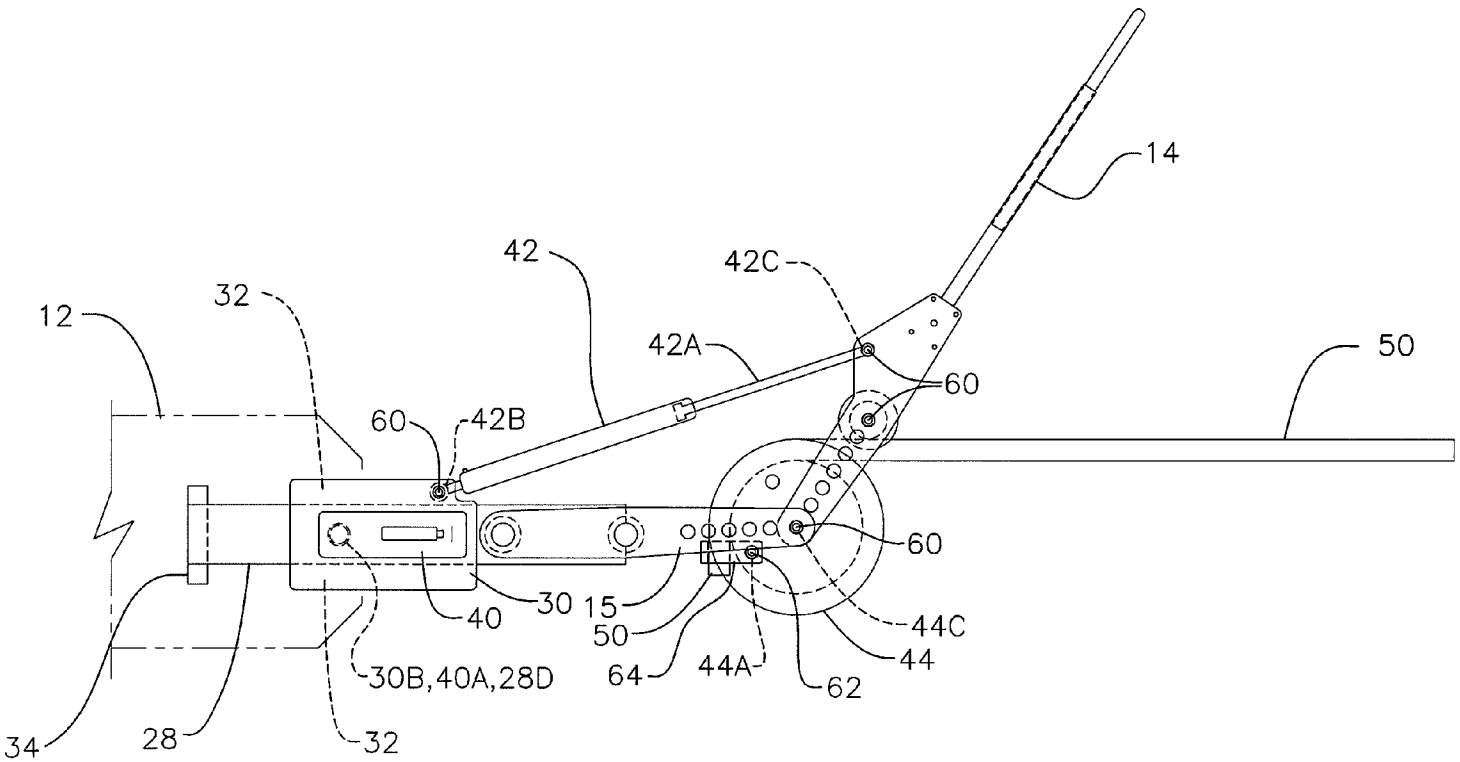
FIG. 12 shows a top view of the apparatus and support after the second bend.

FIG. 12 shows the arrangement of apparatus 10 after foot control 18 A was used to remove pressure from cylinder 42 which retracted ram 42A from the position shown in FIG. 11. The retraction of ram 42A pulled slide 30 to the second location relative to die 44 where it was automatically locked in place by gudgeon 40A being forced into aligned hole 28D in slide bar 28 by coil spring 40C acting against clapper 40, as described in detail earlier. FIG. 12 also shows the result of using foot control valve 18 to make the second bend to provide hydraulic pressure to cylinder 42. This extended ram 42A from the position shown in FIG. 11 to the position shown in FIG. 12. This extension of ram 42A causes lever 46 to rotate form roller 48 around die 44 and bend stock 50 from 45 to 90 degrees around the die.

Figure 13:
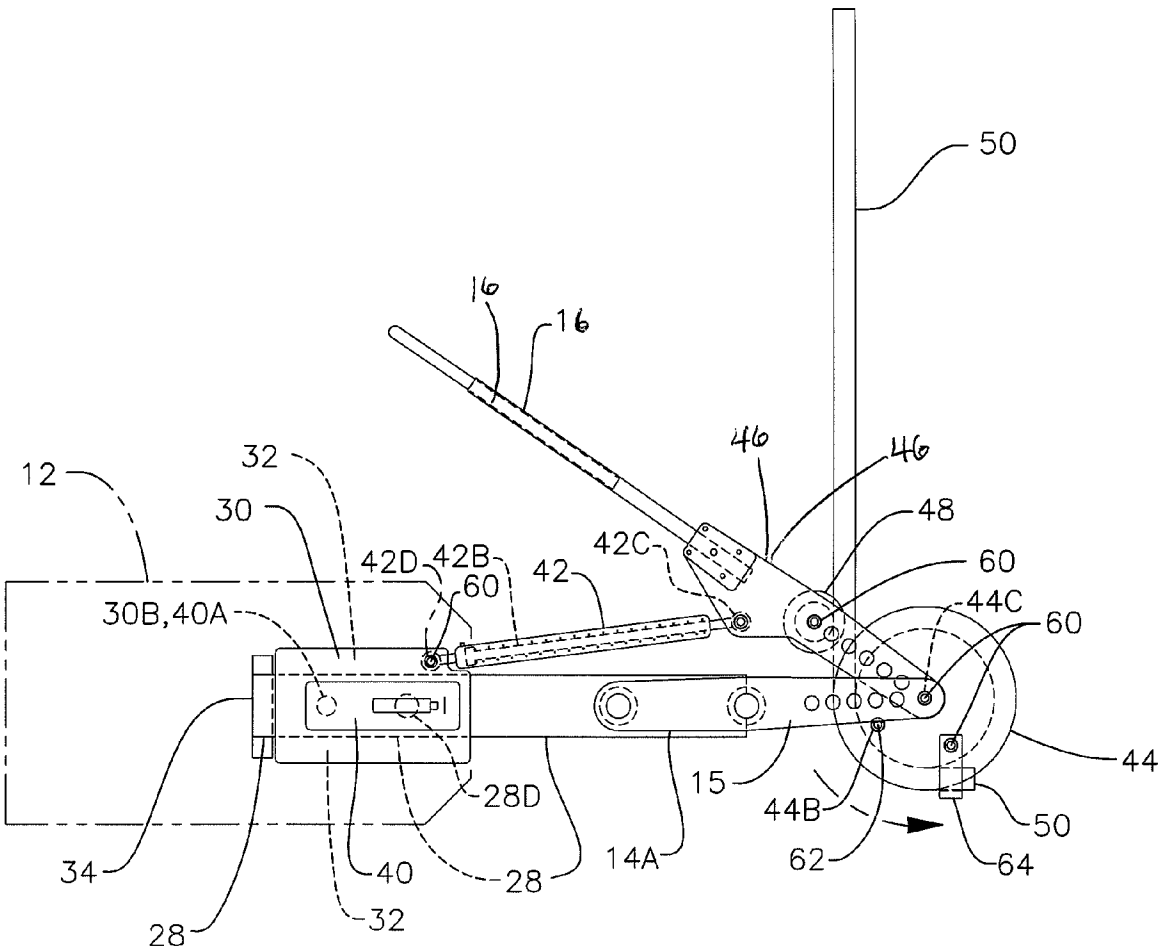
FIG. 13 shows a top view of the apparatus prior to a third bend.

FIG. 13 shows the next arrangement after pressure to cylinder 42 was removed and slide 30 was manually unlocked from slide bar 28 and manually moved outward to the first location against stop 34. Die 44 and stock 50 were also rotated 90 degrees counter-clockwise and secured at the new location by flat sided pin 62 through second stop hole 44B.

Figure 14:
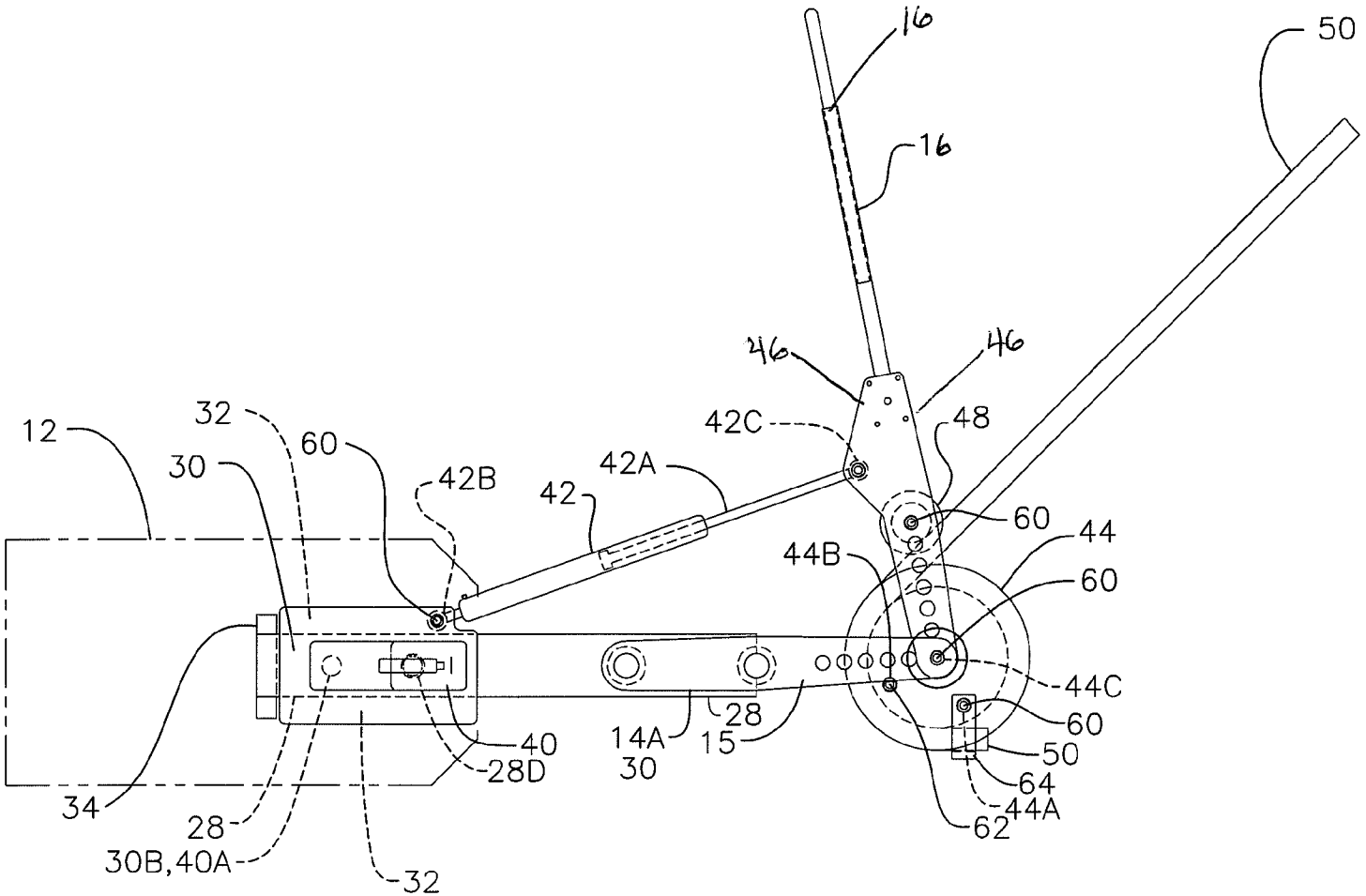
FIG. 14 shows a top view of the apparatus and support after the third bend.

FIG. 14 shows the result of using foot control valve 18 to make the third bend by provided hydraulic pressure to cylinder 42. This extended ram 42A from the position shown in FIG. 13 to the position shown in FIG. 14. The extension of ram 42A caused lever 46 to rotate form roller 48 around die 44 and made a third bend of the stock 50 from 90 degrees to 135 degrees around the die.

Figure 15:
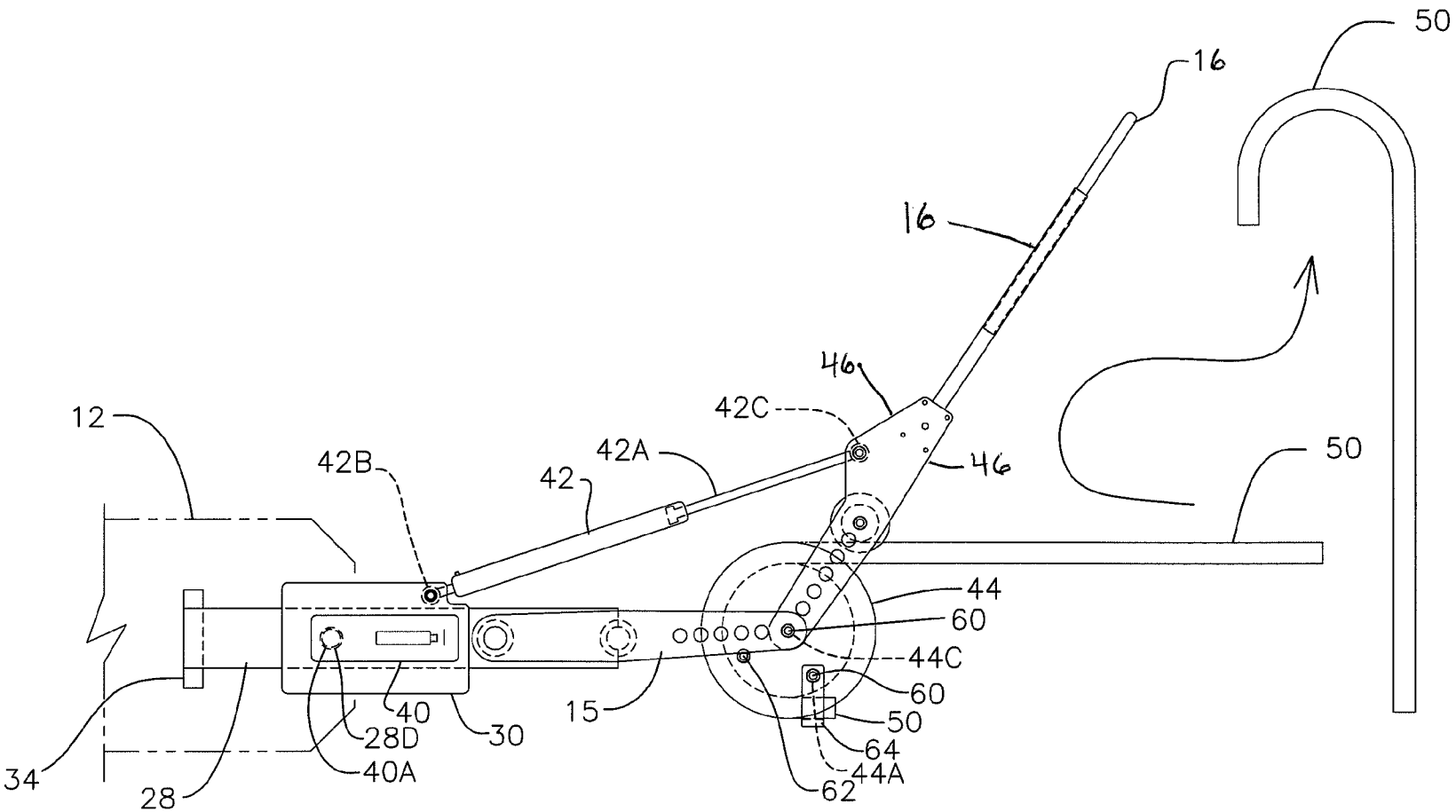
FIG. 15 shows a top view of the apparatus and support after the fourth bend.

FIG. 15 shows the next arrangement of apparatus 10 after control valve 18 was again used to remove pressure from cylinder 42 to retract ram 42A and pull slide 30 to the second location and automatically lock it in place, as described earlier. For the fourth bend, with the apparatus rearranged as described above, hydraulic force is again applied to cylinder 42 using foot control 18. This again results in form roller lever 46 rotating form roller 48 around die 44 which now bends stock 50 around die 44 from 135 degrees to 180 degrees. because of the closer location of cylinder 42.

Figure 16:
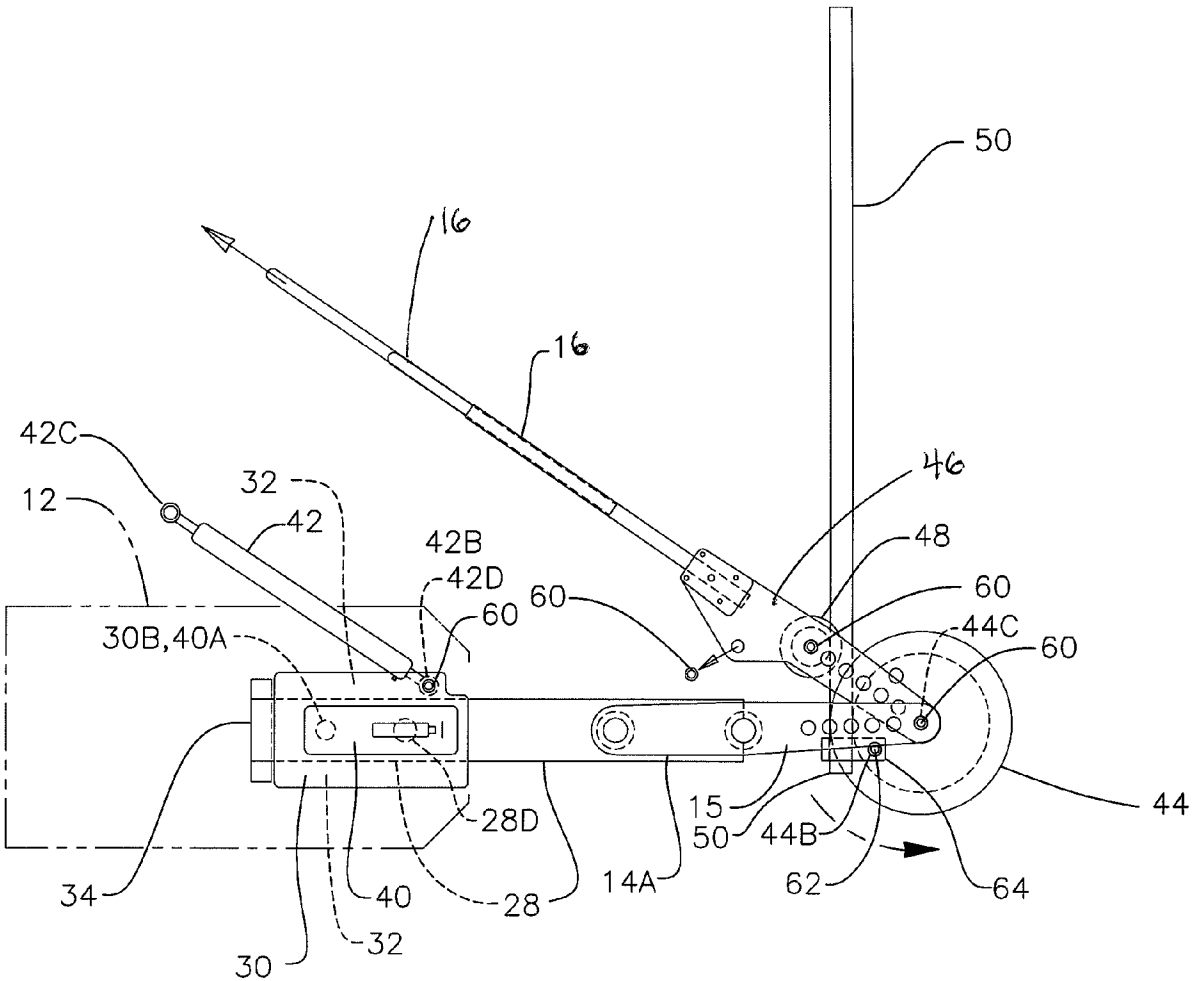
FIG. 16 shows a top view of the apparatus with the cylinder disconnected.

FIG. 16 shows cylinder 42 disconnected and the cylinder pivoted outwardly around ram ring connector 42C. This permits separating cylinder 42 from apparatus 10 while keeping it conveniently located. As described earlier however operating handle 16 and cylinder 42 can both be connected to apparatus 10 and either can be used to provide bending power without interaction or interference.

Figure 17:
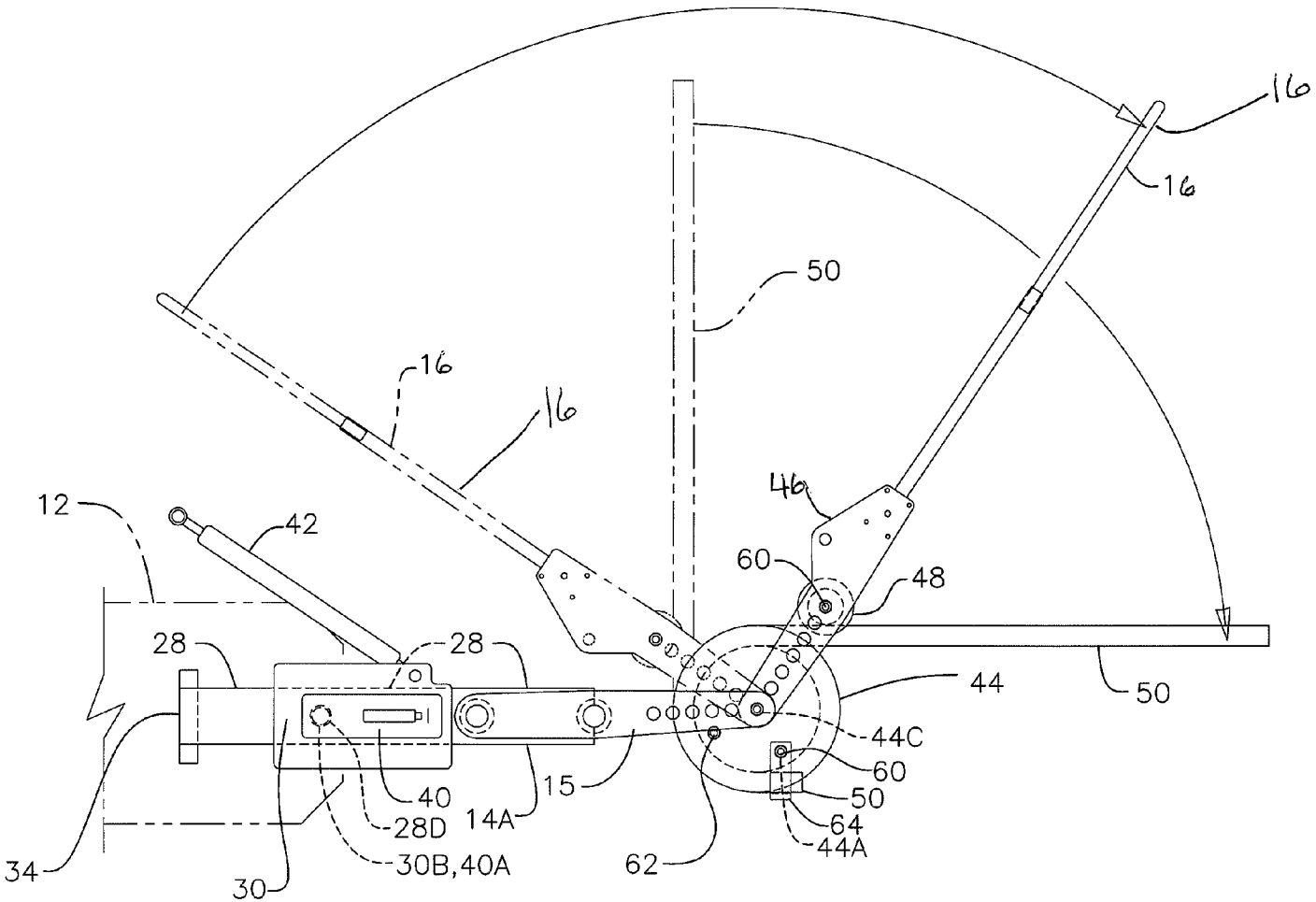
FIG. 17 shows a top view of the apparatus with the cylinder disconnected and the range of motion of the operating handle and a resulting bend.

FIG. 17 shows the range of operating handle 16 when used to drive form roller 48 around die 44 with cylinder 42 and the resulting bending range of stock 50.

It will be understood that this disclosure, in many respects, is only illustrative. Changes may be made in details, particularly in matters of shape, size, material, and arrangement of parts without exceeding the scope of the invention. The ram need not be automatically retractable and arranged to retract the slide since the slide can be moved by hand. The slide need not have an automatic second location lock since this can be provided by merely inserting a pin through aligned holes in the slide and slide bar for both locations. In all these cases however this would require greater operator effort. The apparatus can be used to provide the variety of bend shapes and can bend the different shapes known in the art by simply utilizing the various attachments known in the art by attaching them to the additional holes provided in the arm and the lever. These various parts as well as different die shapes and sizes can be substituted and different arrangements can be obtained simply by removing and installing pins through these various holes. Accordingly, the scope of the invention is as defined in the language of the appended claims.

What is claimed is:

1. Apparatus for bending metal stock comprising:

a) a support;

b) an arm with at least a portion of one end being a slide bar, the slide bar end of the arm being attached to the support with the arm extending outwardly therefrom;

c) a slide having means for slideably attaching the slide to the slide bar resulting in the slide translating linearly along the slide bar relative to the support, the slide and slide bar having securing means for preventing movement of the slide relative to the slide bar at a plurality of locations;

d) a die, a form roller, and a lever, the lever having means for pivotably mounting the form roller thereon, the arm having means for pivotably mounting the die and an end of the lever to the end of the arm opposite to the support, the apparatus being sized to rotate the form roller around the die at a predetermined distance when the lever is rotated around the die;

e) a hydraulic cylinder having an extendable ram, with the cylinder and ram being pivotably connected between the lever and the slide, the apparatus being sized and arranged to rotate the lever around the die through a predetermined angle when the ram is extended over its full range; and f) a hydraulic source means for providing pressurized hydraulic fluid at various flow rates and pressures to the cylinder, the hydraulic source having operator control means for controlling the flow rates and pressure.

2. Apparatus for bending metal stock comprising:

a) a support;

b) an arm with at least a portion of one end being a slide bar, the slide bar end of the arm being attached to the support with the arm extending outwardly therefrom;

c) a slide having means for slideably attaching the slide to the slide bar, the slide and slide bar having securing means for preventing movement of the slide relative to the slide bar at a plurality of locations;

d) a die, a form roller, and a lever, the lever having means for pivotably mounting the form roller thereon, the arm having means for pivotably mounting the die and an end of the lever to the end of the arm opposite to the support, the apparatus being sized to rotate the form roller around the die at a predetermined distance when the lever is rotated around the die;

e) a hydraulic cylinder having an extendable ram, with the cylinder and ram being pivotably connected between the lever and the slide, the apparatus being sized and arranged to rotate the lever around the die through a predetermined angle when the ram is extended over its full range;

f) a hydraulic source means for providing pressurized hydraulic fluid at various flow rates and pressures to the cylinder, the hydraulic source having operator control means for controlling the flow rates and pressure; and g) a first securing means for preventing movement of the slide relative to the slide bar outward relative to the die comprises a stop attached to the support adjacent to the outer end of the slide bar arranged to block movement of the end of the slide beyond the end of the slide bar at a first location.

3. Apparatus as in claim 2 wherein a second securing means for preventing movement of the slide relative to the slide bar comprises means for locking the slide to the slide bar at a predetermined second location closer to the die than the first location.

4. Apparatus as in claim 3 wherein said cylinder has means for retracting an extended ram when pressure is removed from the cylinder, and when the slide is located at the first location with the ram extended, the apparatus being sized and arranged to result in the slide translating along the slide bar from the first to the second location when the ram is retracted from an extended to a retracted position.

5. Apparatus as in claim 3 wherein said second securing means further comprises automatic locking means for automatically locking the slide to the slide bar whenever the slide is located at said second location.

6. Apparatus as in claim 5 further comprising the automatic locking means shaving means for manually releasing the lock.

7. Apparatus as in claim 6 wherein the automatic locking means comprises:

a) a clapper; and b) a gudgeon attached to the clapper facing outwardly from a surface near one end thereof, the clapper having means for pivotably attaching the end of the clapper opposite the gudgeon near the end of the slide opposite the support with the gudgeon facing the slide, and further having spring means for urging the gudgeon towards the slide, the slide having a hole therethrough opposite the gudgeon sized to admit the gudgeon with the gudgeon being urged therethrough, the slide bar having a hole therethrough sized and located to admit the gudgeon when the slide is at the second location relative to the slide bar, with the gudgeon having a length adequate to extend through the holes in the slide and slide bar and lock the slide to the slide bar.

8. Apparatus as in claim 7 wherein the means for releasing the lock comprises a clapper handle attached to the surface of the clapper opposite the slide and near the end opposite the support, the handle being arranged to permit manually pressing the outer end of the handle toward the slide and pivot the opposite end of the clapper outward from the slide to remove the gudgeon from the hole in the slide bar.

* * * * *